US005221919A

United States Patent [19]

Hermans

[11] Patent Number: 5,221,919

[45] Date of Patent: Jun. 22, 1993

[54] ROOM OCCUPANCY SENSOR, LENS AND METHOD OF LENS FABRICATION

[75] Inventor: Albert L. Hermans, San Leandro, Calif.

[73] Assignee: Unenco, Inc., San Leandro, Calif.

[21] Appl. No.: 755,790

[22] Filed: Sep. 6, 1991

[51] Int. Cl.[5] ..... G08B 13/18

[52] U.S. Cl. ..... 340/567; 250/342; 340/693

[58] Field of Search ..... 340/567, 555, 693, 514, 340/516, 309.15; 250/221, 342, 349, 353, 208.4

[56] References Cited

U.S. PATENT DOCUMENTS

| | | | |
|---|---|---|---|
| 3,480,775 | 11/1969 | Osborne | 340/567 X |
| 3,631,434 | 12/1971 | Schwarz | 340/567 |
| 3,760,399 | 9/1973 | Schwarz | 340/567 |
| 3,958,118 | 5/1976 | Schwarz | 250/221 |
| 4,176,348 | 11/1979 | Tobin et al. | 340/514 X |
| 4,447,726 | 5/1984 | Mudge et al. | 250/342 |
| 4,703,171 | 10/1987 | Kahl et al. | 250/221 |
| 4,757,204 | 7/1988 | Baldwin et al. | 250/342 |
| 5,015,994 | 5/1991 | Hoberman et al. | 340/567 |
| 5,017,783 | 5/1991 | Mousavi | 250/353 |
| 5,107,120 | 4/1992 | Tom | 250/342 |
| 5,128,654 | 7/1992 | Griffin et al. | 340/567 |

*Primary Examiner*—Thomas Mullen
*Attorney, Agent, or Firm*—Harris Zimmerman

[57] ABSTRACT

Apparatus for sensing occupancy of a room detects the infrared energy that is radiated by persons and may be used actuate any of a variety of devices such as electric lights, heating systems, air conditioners or alarms. Detection of persons throughout a broad area is made possible by a dome shaped lens assembly having an array of Fresnel lens segments which face in different directions and which focus intercepted infrared towards one or more infrared sensing components. Economical fabrication of the lens is realized by forming the Fresnel lens grooves in a sheet of material while it is in a flat condition and then sandwiching the material between nested dome shaped frameworks. In the preferred form, the sensor includes an adapter which can support different numbers of infrared sensors in any of a plurality of different orientations to accommodate to the configurations of different rooms.

6 Claims, 7 Drawing Sheets

ROOM OCCUPANCY SENSOR, LENS AND METHOD OF LENS FABRICATION

TECHNICAL FIELD

This invention relates to apparatus for sensing the presence of persons in a room and more particularly to devices of this kind which detect the infrared wavelengths that radiate from the human body. The invention also provides an advantageous method of fabricating a dome shaped lens for use in sensing devices.

BACKGROUND OF THE INVENTION

Devices for sensing the presence of one or more persons in a room are used extensively for the purpose of actuating security alarms and can also serve a variety of other purposes. Energy savings can be realized by using such devices to turn on lights, heating, air conditioning or other equipment only when it is actually needed and to turn such facilities off when a room is unoccupied.

One type of occupancy sensor responds to the infrared energy which is radiated by the human body. Such sensors include a pyroelectric component of the type which exhibits an electrical voltage or a change of electrical resistance in response to infrared radiation. Circuits in the sensor detect this change and respond by transmitting an actuating signal to one or more electrically controlled devices that are to be turned on when the room is occupied.

Such sensors may also include means for intercepting infrared that arrives from different directions and for concentrating the intercepted infrared at the location of the pyroelectric component. This broadens the range of the sensor. Prior sensors typically use reflectors for this purpose. This has an adverse effect on sensitivity as significant losses of infrared energy occur during the process of reflection.

Intercepted infrared can also be focused towards the location of the pyroelectric component by lenses which are inherently more efficient than reflectors. Prior lenses for this purpose have an undesirably narrow field of view and this makes it necessary to provide a complex and costly assembly of such lenses if the sensor must detect a person at any location within a sizable room.

Sensors of the above described kind have a detection pattern which is the outline of region within which the sensor will detect infrared. The ideal pattern varies from room to room. For example, a detection pattern that approximates a square is appropriate for rooms which have a similar configuration while a long narrow pattern is more appropriate for a hallway. Tailoring of the detection pattern to accommodate to the requirements of different rooms is an undesirably complicated process in the prior occupancy sensors as it requires restructuring of a number of different components. Testing of the prior sensors at the time of installation, to assure that it responds to the presence of a person at different locations in a room, is an undesirably complicated and time consuming process.

The present invention is directed to overcoming one or more of the problems discussed above.

SUMMARY OF THE INVENTION

In one aspect, the present invention provides a sensor for detecting occupancy of a room which sensor includes a housing, means for detecting changes of infrared radiation intensity and means for actuating at least one electrically controlled device in response to detection of the changes of infrared intensity. A substantially dome shaped infrared transmissive lens is secured to the housing and has a plurality of infrared focusing Fresnel lens segments which face in a plurality of different directions and which are oriented to direct intercepted infrared radiation to the detecting means.

In another aspect of the invention, the lens segments are formed of infrared transmissive sheet material, each lens segment having a plurality of curvilinear grooves formed in the sheet material. The grooves of each lens segment conform to segments of concentric circles of progressively increasing diameter.

In another aspect of the invention the lens includes a substantially dome shaped outer cage having a plurality of infrared transmissive regions that face in different directions. A substantially dome shaped inner cage, also having a plurality of infrared transmissive regions that face in different directions, is nested within the outer cage. A sheet of infrared transmissive material is sandwiched between the inner and outer cages and the lens segments are formed in the sheet of material.

In another aspect of the invention the sensor housing has an opening in one surface and an adapter at the opening supports the infrared detecting means. The dome shaped lens bas a large diameter end disposed against the housing surface in a substantially centered relationship with the adapter.

In another aspect of the invention, a sensor for detecting the presence of persons in a room includes a housing having an opening in the bottom surface and means for enabling attachment of the housing to the ceiling of a room. At least one infrared sensing component is disposed at the opening. The sensor further includes timer means for actuating an electrically controlled device for an interval of time in response to each detection of an abrupt change of infrared intensity by the sensing component or components. A substantially dome shaped infrared transmissive lens is secured to the bottom of the housing and encircles the sensing component or components. The lens has an outer framework and inner framework disposed in a nested relationship and a sheet of infrared transmissive material is nested between the frameworks. The sheet of material has a plurality of grooves in one surface which are shaped to define a plurality of Fresnel lens segments which are oriented to focus intercepted infrared radiation towards the region of the sensing component.

In still another aspect, the invention provides a lens assembly for concentrating radiant energy that arrives from any of a plurality of different directions including opposite directions. A substantially dome shaped outer cage has open areas bounded by framework and a similarly shaped inner cage, also having open areas bounded by framework, is nested in the outer cage. A sheet of radiant energy transmissive flexible material is nested between the outer and inner cages. A plurality of Fresnel lens segments are formed in a surface of the sheet and face in different directions around the perimeter of the lens assembly, each of the lens segments having a plurality of curved grooves which conform to segments of concentric circles of progressively increasing diameter.

In still another aspect, the invention provides a method of fabricating a lens assembly for concentrating radiant energy that arrives from any of a plurality of different directions including opposite directions. Steps in the method include forming a plurality of Fresnel lens segments in a surface of a sheet of radiant energy transmissive flexible material by forming a plurality of curved grooves in each segment that conform to segments of concentric circles of progressively increasing diameter. Formation of the lens segments is performed while the sheet is in a flattened condition. The sheet is cut into a configuration which has a central area and a plurality of petal-like areas that extend in different angular directions around the perimeter of the central area. The petal-like areas are then flexed to form the sheet into a substantially dome shaped configuration. The flexed sheet is sandwiched between a pair of nested dome shaped open frameworks to maintain the sheet in the dome shaped configuration.

The invention provides a room occupancy sensor that can respond to infrared arriving from diverse different locations in a room without requiring reflectors or a costly and complex system of lenses for the purpose. In the preferred form, the sensor has a construction which enables the detection pattern to be altered to accommodate to a particular room with only a minor alteration of components. The preferred form of the invention also facilitates testing by enabling a temporary shortening of the time interval during which the sensor actuates a controlled device following each sensing of a change in infrared intensity and by providing an immediate visible indication that movement of a persons body has been detected. The method of the invention provides an economical and uncomplicated procedure for fabricating a dome shaped lens having an array of differently oriented Fresnel lens segments which lens configuration would be exceedingly difficult to produce by conventional lens manufacturing procedures.

The invention, together with further aspects and advantages thereof, may be further understood by reference to the following description of the preferred embodiments and by reference to the accompanying drawings.

DETAILED DESCRIPTION OF THE PREFERRED EMBODIMENTS

Figure 1:
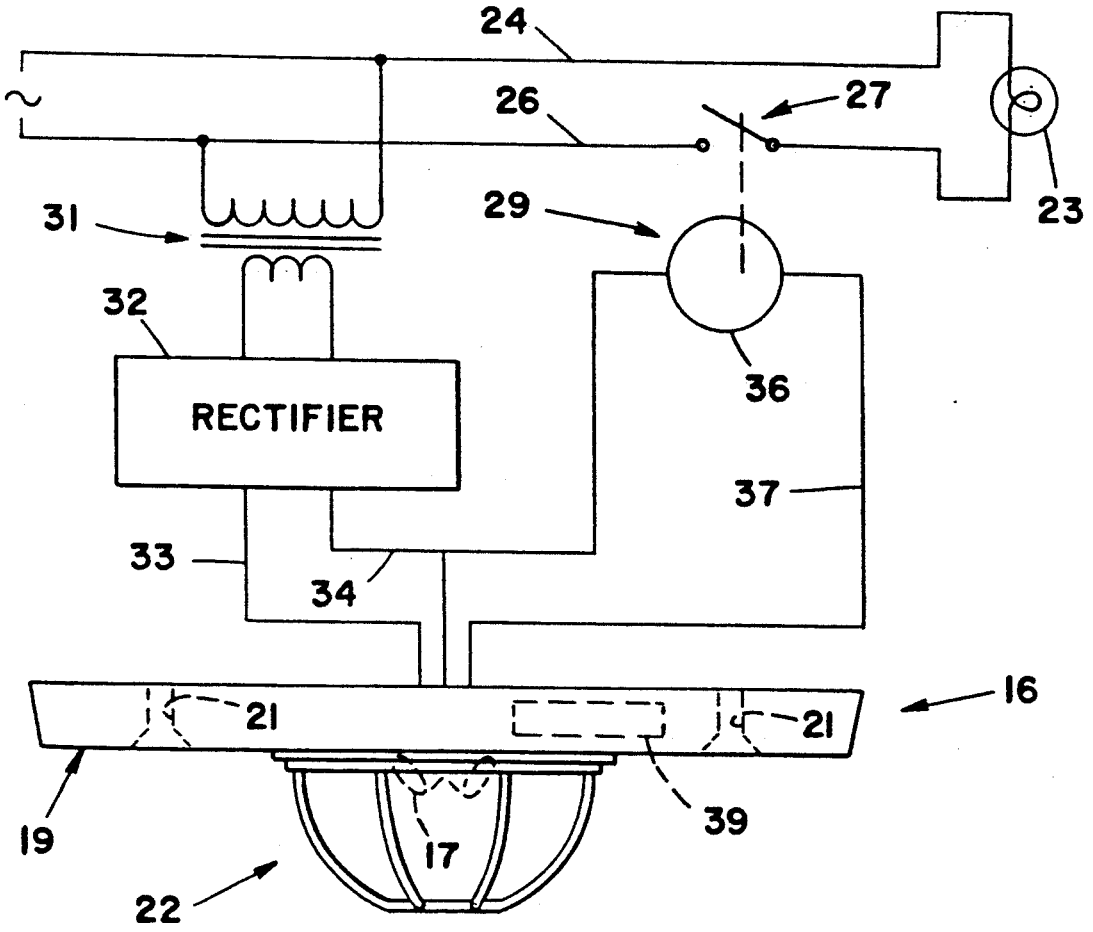
FIG. 1 is a side elevation view of a room occupancy sensor embodying the invention in which certain electrical devices with which the sensor coacts are shown in schematic form.
Figure 2:
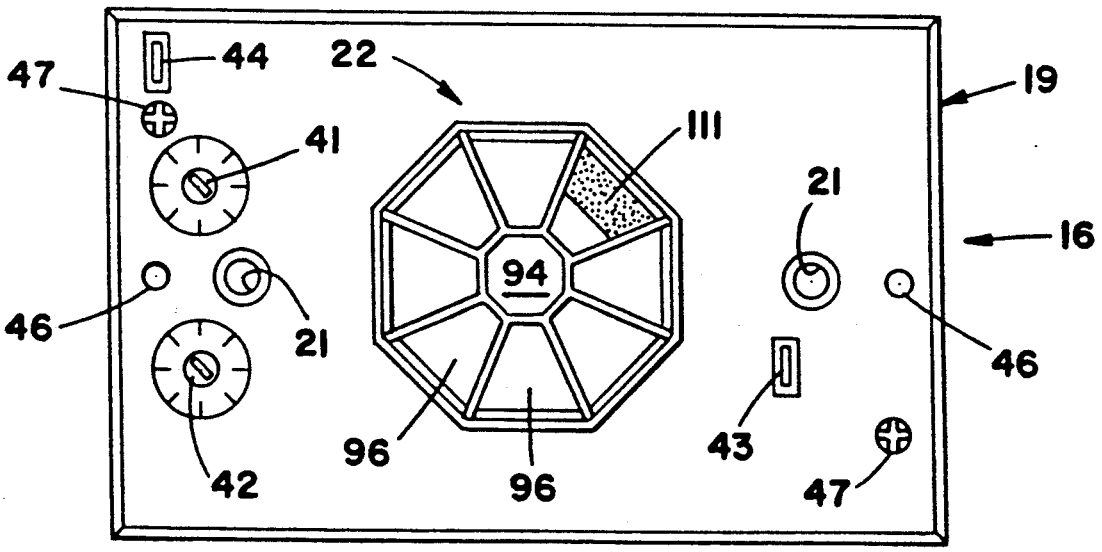
FIG. 2 is a view of the underside of the room occupancy sensor of FIG. 1.

Referring initially to FIGS. 1 and 2 of the drawings in conjunction, a room occupancy sensor 16 in accordance with the invention includes one or more infrared detectors 17 of the known type that produce an electrical voltage in response to irradiation by infrared energy, there being four such components in this particular example. One suitable example of a detector 17 of this kind is manufactured in Japan by Nippon Ceramics Co. Ltd and identified as Model RE200B Pyroelectric Detector.

The infrared sensing components 17 are disposed at the underside of a rectangular housing 19 which has spaced apart vertical passages 21 for receiving screws (not shown) to attach the sensor 16 to the ceiling of a room preferably at an electrical gang box of the standardized form. An inverted dome shaped lens 22 is also secured to the underside of housing 19 and is centered under the detectors 17. As will hereinafter be described in more detail, lens 22 intercepts infrared that is radiated by persons in the room and focuses the infrared towards a detector 17.

For purposes of example, FIG. 1 depicts the sensor 16 as being used to turn on a light bulb 23 when one or more persons enter the room and to turn off the light after the room becomes unoccupied. The sensor 16 may also be used to actuate and deactuate any of a variety of other electrically controlled devices of which heating installations, air conditioners and burglar alarms are examples. The sensor 16 may be connected to control a number of such devices simultaneously.

The controlled device such as light bulb 23 may be connected across standard A.C. utility power conductors 24 and 26 through contacts 27 of a normally open relay 29. Relatively low voltage D.C. current for operating sensor 16 and relay 29 may be provided by connecting the primary winding of a voltage step-down transformer 31 across the utility power conductors 24 and 26 and by connecting the secondary side of the transformer to a rectifier 32. The low voltage direct current output of rectifier 32 is transmitted to sensor 16 by first and second sensor lead wires 33 and 34. The driver coil 36 of relay 29 is connected across the second lead wire 34, which is the negative D.C. lead wire, and a third lead wire 37 of the sensor 16. In the United States of America, utility power conductors 24 and 26 typically provide 60 cycle, 115 volt alternating current. Transformer 31 and rectifier 32 may be selected to provide 24 volt direct current to the sensor 16 as this enables use of economical low voltage wiring.

Transformer 31, rectifier 32 and relay 29 can be the corresponding components of a standard power pack of the type which is widely used in building wiring systems and the present embodiment of the invention is designed to be coupled to such a power pack. Alternately, the transformer 31, rectifier 32 and relay 29 can be components of the sensor 16 itself which are contained within housing 19 in which case the sensor is connected directly to the A.C. utility power conductors 24 and 26.

As will hereinafter be described in more detail, housing 19 contains a timer circuit 39 which responds to signals from the detectors 17 by energizing relay driver coil 36 for a limited period of time and then de-energizing the coil if no subsequent detector signal has been produced during that time period.

Referring to FIG. 2 in particular, additional externally visible components of this embodiment include first and second rotary variable resistors 41 and 42 which respectively enable adjustment of the sensitivity of the sensor 16 to changes of infrared intensity and variation of the above discussed on time interval that is established by the timer circuit. The time interval may be varied within the range of 6 minutes to 15 minutes in this particular embodiment to accommodate to the amount of human activity that occurs in a particular room although other time periods can also be appropriate. The shorter times provided by adjustment of variable resistor 42 are appropriate in large rooms where a high level of human activity occurs such as in a school classroom as one example. Motions of a human body of the type to which the sensor 16 responds occur almost continually in rooms of this kind. The longer time periods are appropriate at locations where a single individual or a small number of persons may be present and where the person or persons may be inactive at times.

Two key slots 43 and 44 are provided in the underside of housing 19. As will further described, insertion of a key into slot 43 causes a bypassing of the sensor 16 circuits when it is desired to maintain the controlled device in an on condition regardless of occupancy of the room. Insertion of a key into slot 44 foreshortens the above disussed timer interval to facilitate testing of the response of the sensor 16 following installation. Testing is also facilitated by a pair of light producing devices such as light emitting diodes 46 which are disposed at visible locations on the underside of housing 19. As will be further described, diodes 46 blink on momentarily each time that a change of infrared intensity is detected and processed. This enables testing of the response of the sensor 16 from various locations in the room by simply waving a hand. The diodes 46 are situated at diametrically opposite sides of lens 22 to enable viewing of at least one of the diodes from any location in the room.

Small bolts 47, visible at the underside of housing 19, hold the components of the housing together.

Figure 3:
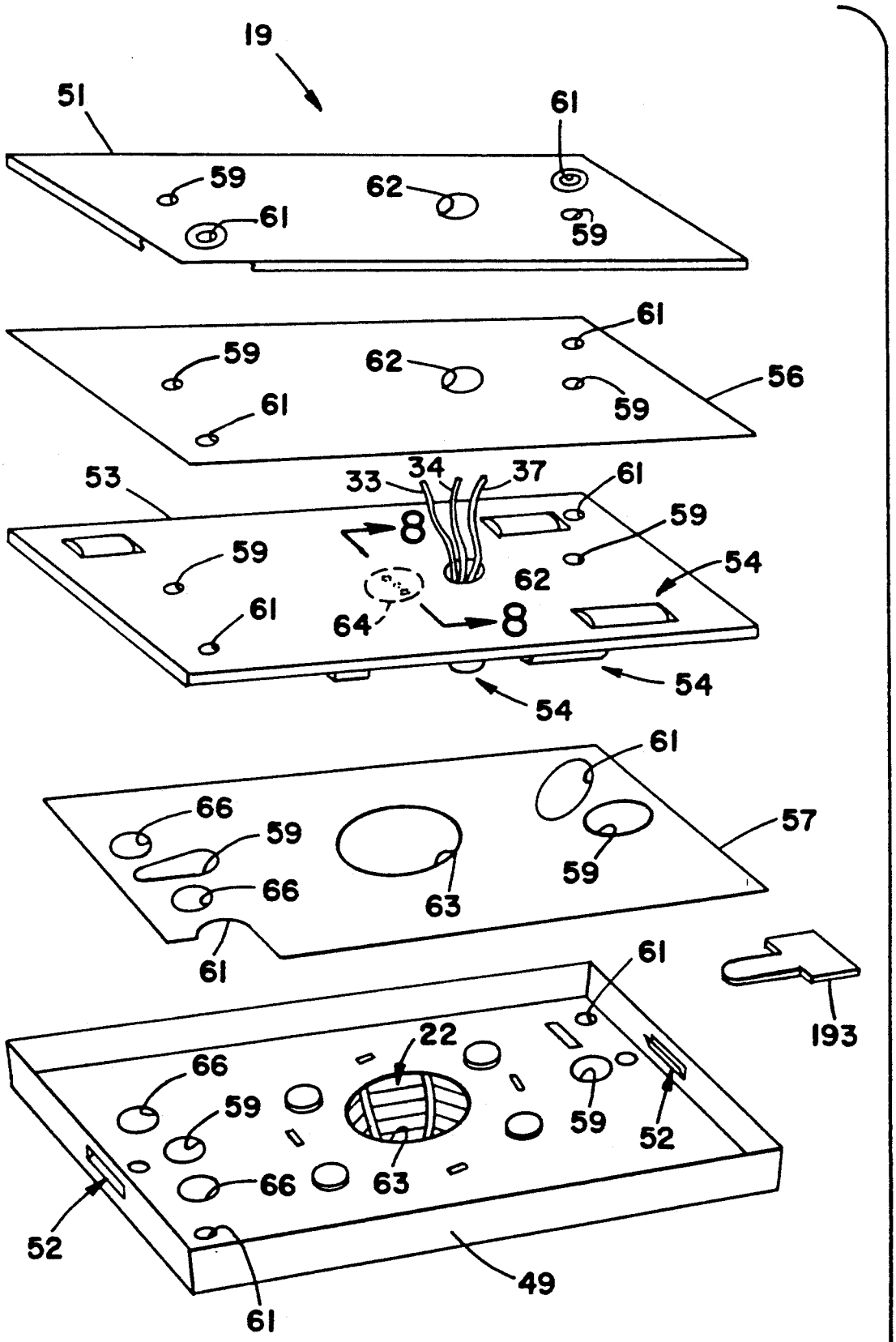
FIG. 3 is an exploded perspective view of components of the sensor of the preceding figures.

With reference to FIG. 3, the housing 19 may have a tray shaped bottom member 49 and a conforming flat top cover 51 which seats on small inwardly extending ledges 52 formed in opposite end walls of the bottom member. The bottom member 49 and top cover 51 are preferably formed of metal to shield the interior of housing 19 from radio frequency interference.

A printed circuit board 53, carrying components 54 of the circuit which will be hereinafter described, is contained between bottom member 49 and cover 51. Conforming rectangular sheets 56 and 57 of insulative paper are disposed immediately above and below circuit board 53 to prevent contact of the circuit components with the metal cover 51 and bottom member 49.

Bottom member 49, insulative sheets 56 and 57 and cover 51 are provided with aligned openings 59 to receive the screws or the like which fasten the sensor to a ceiling. Each such component also has additional aligned openings 61 to receive the bolts which fasten the components of the housing 19 together. Circuit board 53, the upper insulative sheet 56 and cover 51 have still other aligned openings 62 through which the three electrical leads 33, 34 and 37 extend to the exterior of housing 19 when the components are assembled. Relatively large circular openings 63 at the centers of bottom member 49 and in the lower insulative sheet 57 enable an adapter 64, which carries the infrared detectors 17 (shown in FIG. 1), to extend from circuit board 53 down into the upper region of the dome shaped lens 22. Additional openings 66 in bottom member 49 and lower insulative sheet 57 provide access to the variable resistors 41 and 42 (shown in FIG. 1) which are secured to the underside of the circuit board 53.

Figure 4:
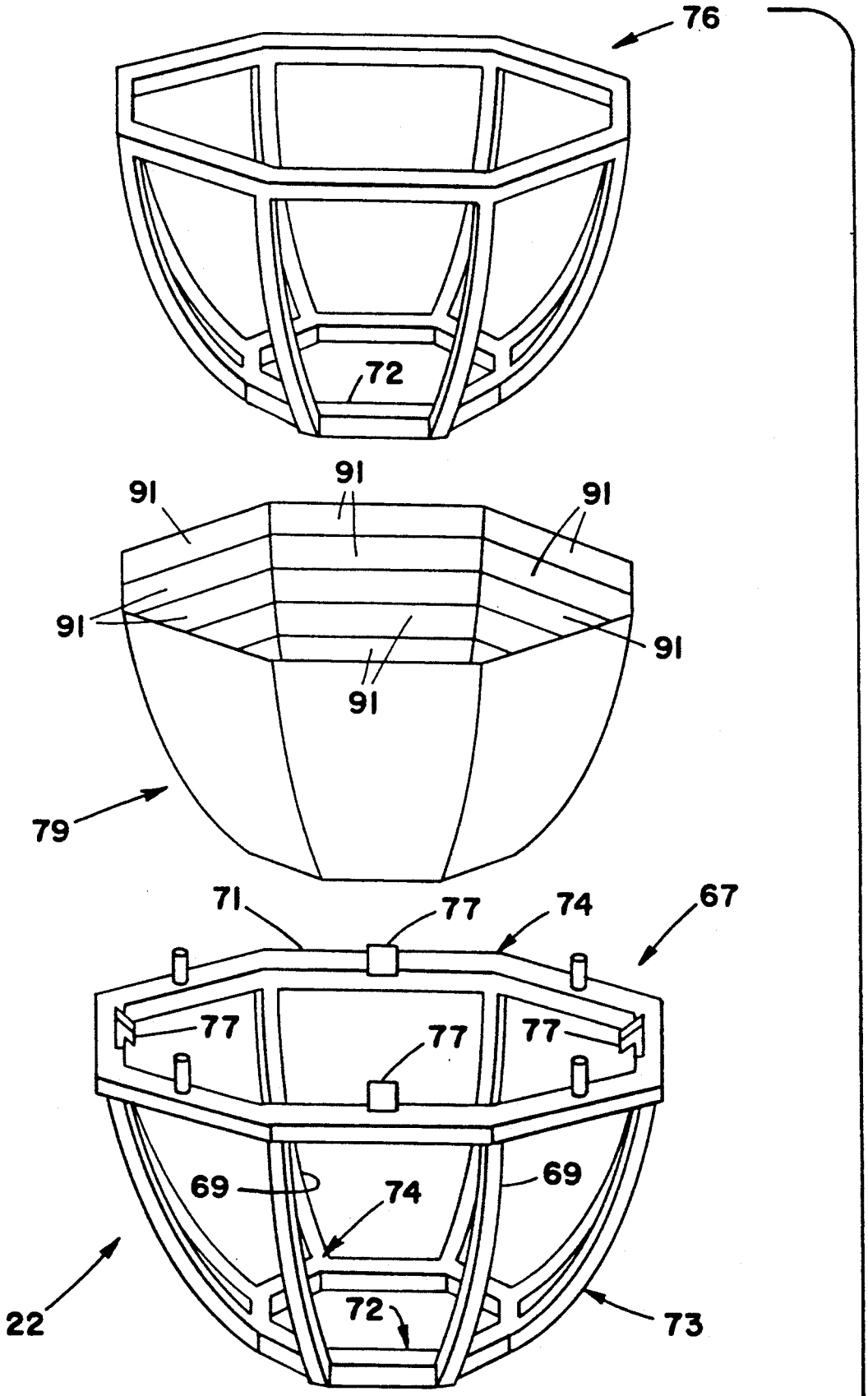
FIG. 4 is an exploded perspective view of components of a lens which forms a part of the sensor of the preceding figures.
Figure 5:
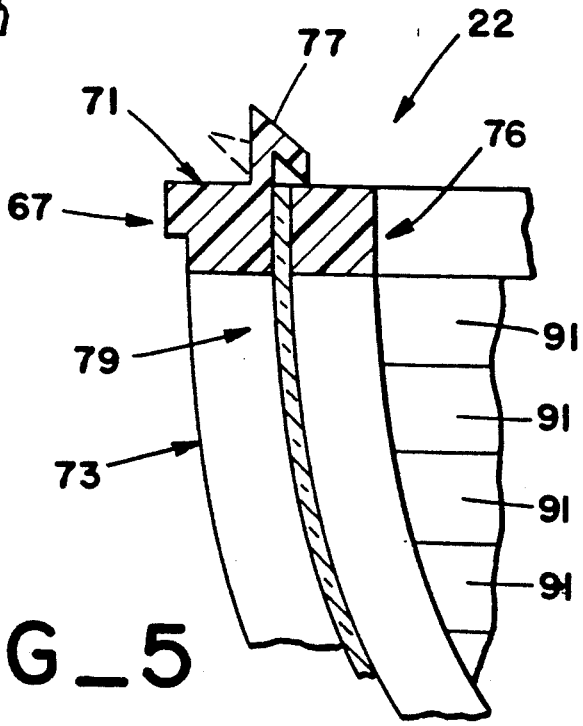
FIG. 5 is a cross section view of an upper side region of the lens assembly.

Referring jointly to FIGS. 4 and 5, the lens 22 functions to intercept infrared that arrives from different angular directions, including opposite directions, and to focus and concentrate the intercepted infrared towards at least one of the previously described detectors. Components of the lens 22 include a dome shaped outer cage or framework 67 having open areas 69 that face in different directions around the perimeter of the cage. The upper rim portion 71 of cage 67 is preferably of octagonal configuration and the lower end portion 72 is of similar configuration but of smaller diameter. Curved rib portions 73 of cage 67 extend between the angulations 74 of the upper and lower portions 71 and 72.

An inner cage or framework 76 has a configuration similar to that of the outer cage 67 except that it is proportioned to fit within the outer cage in a nested relationship. Resilient hooked tabs 77 extend up and slightly inward from locations around the upper rim portion 71 of outer cage 67 to snap engage the two cages 67 and 76 in the nested relationship. As best seen in FIG. 5 in particular, the tabs 77 are deflected outward as the inner cage 76 is forced into the outer cage 67 and then spring back over the top of the inner cage to latch the two cages together.

Referring again to FIGS. 4 and 5 in conjunction, focusing of infrared onto the detectors is effected by a lens element 79 which is fabricated from infrared transmissive flexible material and which is formed into a dome shaped configuration conforming to the shape of the cages 67 and 76 to enable the lens element to be sandwiched between the nested cages. One surface, preferably the inner surface, of lens element 79 is formed to provide an array of Fresnel lens segments 91 which extend transversely across the open area 69 of cages 67 and 76 when the lens 22 components are assembled. An additional group of such lens segments **91*a*, shown in FIG. 6, face downward and extend across the lower end portions 72 of the cages 67 and 76 when the lens components are assembled. Referring again to FIGS. 4 and 5, the lens segments 91 at each open area 69 are oriented to focus intercepted infrared at the same location which is situated near the top of the lens 22 assembly to enable detection of the focused infrared by a detector. The downwardly facing lens segments 91*a* are oriented to focus intercepted infrared rays at a location which is at the vertical centerline of the dome shape lens 22** and at the top region of the lens.

Figure 7:
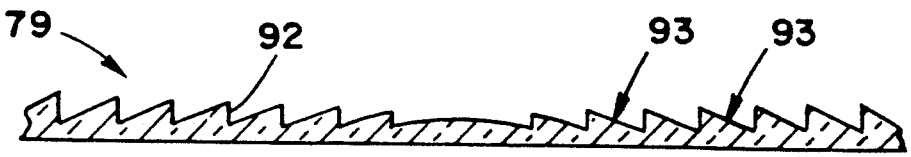
FIG. 7 is a enlarged cross section view of the lens segment array taken along line 7—7 of FIG. 6.
Figure 6:
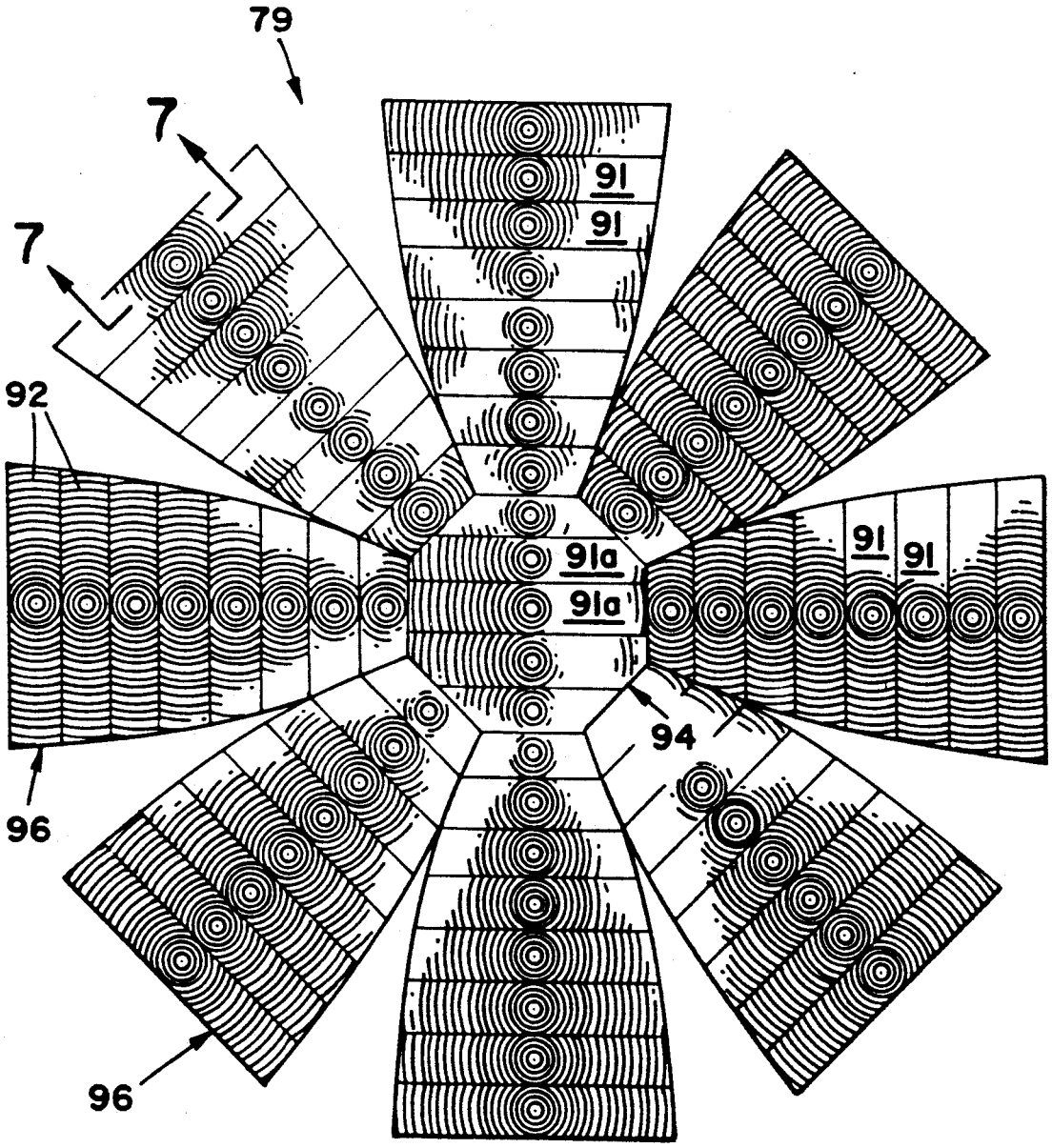
FIG. 6 is a plan view of an array of Fresnel lens segments as it appears prior to assembly with other components of the lens of FIGS. 5 and 6.

Referring jointly to FIGS. 6 and 7, the surface of a Fresnel lens has a series of grooves 92 that conform with concentric circles of progressively increasing diameter. In the present instance a majority of the grooves 92 of each lens segment 91, 91*a* conform with only segments of such circles owing to the elongated essentially rectangular shape of the lens segments. Faces 93 of the successive groves 92 are curved to jointly provide the focusing effect of an ordinary ungrooved and much thicker convex lens.

The invention enables fabrication of a domed shaped array of Fresnel lens segments 91, 91*a* in a much more economical manner than would be possible if conventional lens manufacturing techniques were used. In particular, the grooves 92 of all lens segments 91, 91*a* may be die stamped, molded or be otherwise formed simultaneously in one operation as this may be done while the lens element 79 is still in a flat condition. Prior to or after formation of the grooves 92 the material of the lens element 79 is trimmed to provide an octagonal central area 94 and eight arms 96 that extend outward from the central area at equiangular intervals around the perimeter of the central area. Referring jointly to FIGS. 4 and 6, the central area 94 is proportioned to conform in outline with the lower portions 72 of cages 67 and 76 and the arms 96 are trimmed to span the open areas 69 of the cages when the arms are flexed into a curvilinear configuration conforming to the curvature of the ribs 73 of the cages.

The flexed lens element 79 is then nested between the cages 67 and 76 and is held in the dome shaped configuration by the clamping action of the nested cages and preferably also by adhering the edges of arms 96 to each other and to the cages with a suitable adhesive.

Figure 8:
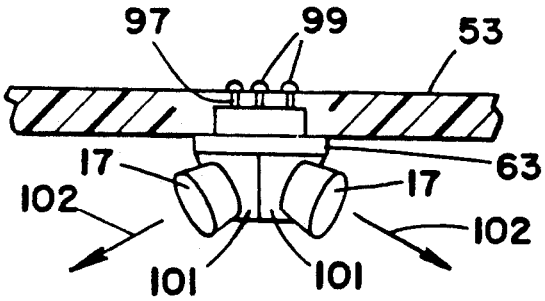
FIG. 8 is a partial cross section view taken along line 8—8 of FIG. 3 and showing the infrared sensing components and a supporting adapter.
Figure 9:
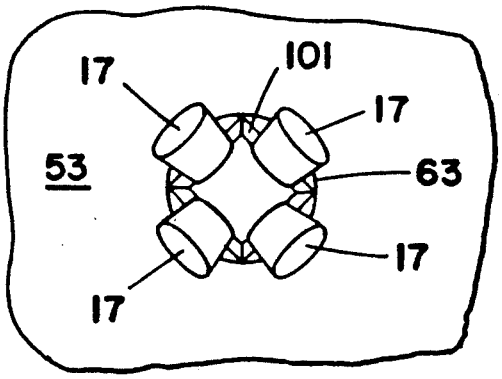
FIG. 9 is a view of the underside of the components that are depicted in FIG. 8.

The above described lens 22 assembly provides further manufacturing economies in that only minor changes in the construction of the sensor are needed to provide a variety of different detection patterns. Referring jointly to FIGS. 8 and 9, the adapter 63 which supports the infrared detectors 17 has three conductive pins 97 which extend up through the center of circuit board 53 and which are the electrical terminals of the detectors. Solder beads 99 at the upper ends of pins 97 function both to hold the adapter 63 at the circuit board 53 and to provide for electrical connections to printed circuits on the board. The lower portion of adapter 63 has four flat sides 101 which face outward in directions that are at right angles to each other and which are also inclined at an angle which may be about 30° away from vertical. Each of the four infrared detectors 17 is secured to a separate one of the sides 101 with the optical axis 102 of each detector being normal to the side 101 at which the detector is secured to the adapter 63. Referring to FIGS. 1 and 8 in conjunction, adapter 63 in this particular embodiment is oriented to cause the detectors 17 to be directed towards the ones of the lens arms 96 that are diagonally positioned relative to the sides and ends of the sensor 16. This provides for maximum range when the sensor 16 is secured to the center of the ceiling of a square room 103 in parallel relationship with the walls of the room as the optical axes 102 of the detectors are directed at the corners of the room which are the portions of the room that are most distant from the sensor.

Figure 10:
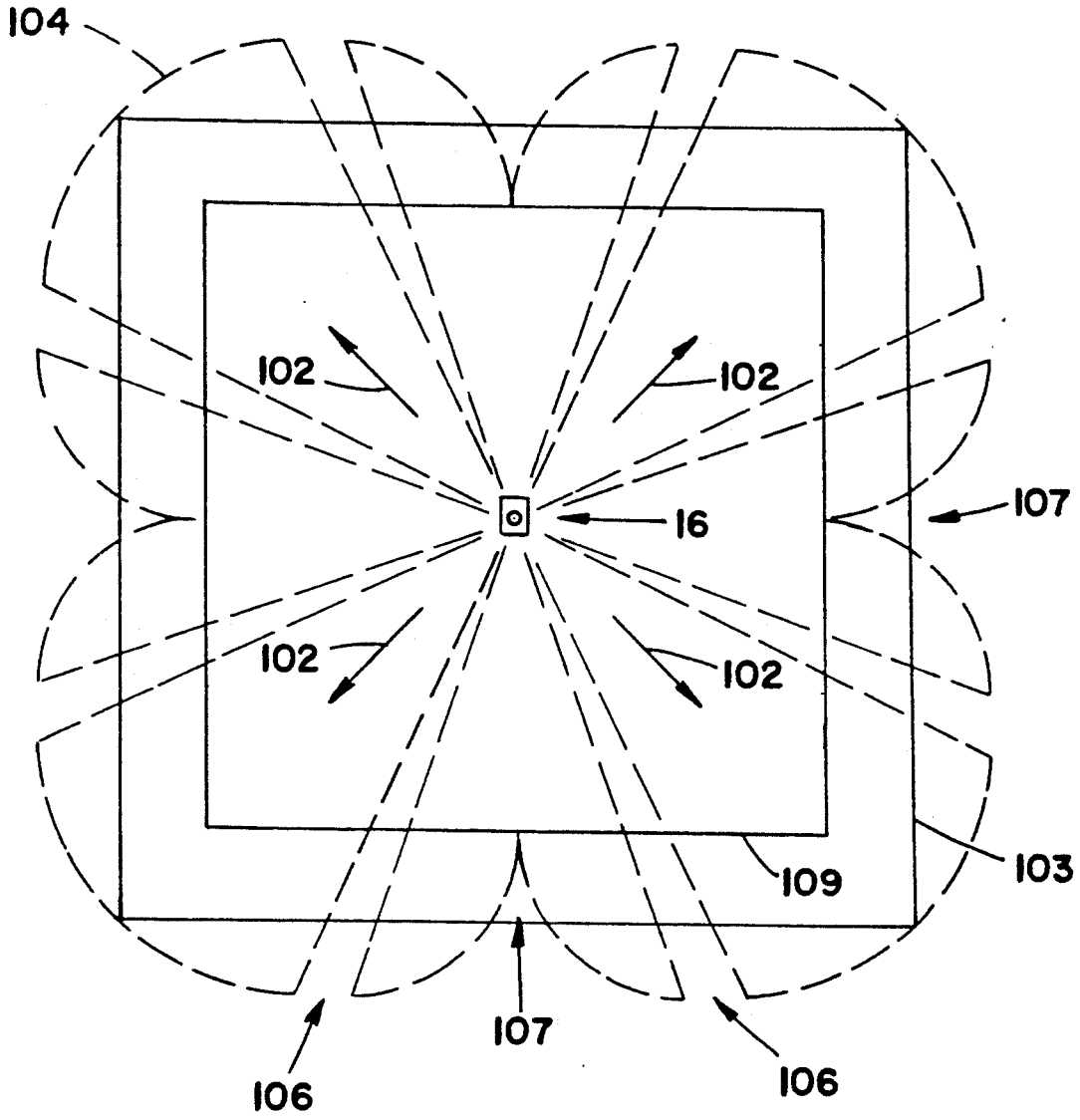
FIG. 10 is a diagram of the floor of a room showing the deflection pattern produced by the arrangement of components depicted in FIGS. 8 and 9.
Figure 11:
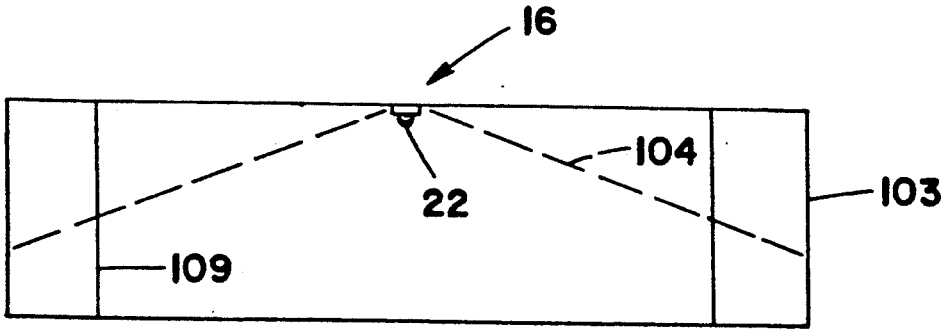
FIG. 11 is a diagrammatic elevation view of the room and deflection pattern of FIG. 10.

Referring jointly to FIGS. 10 and 11, dashed outline 104 indicates the detection pattern of the above described embodiment of the invention. The room outlined at 103 has sides which are fifty feet in length. Sensor 16 is responsive to waving of a human hand at the boundaries of the room that are within dashed outline 104 and detects one walking step at the narrow tapered zones 106 in which response is reduced by the octagonal configuration and opaque framework of the lens 22 assembly. Small areas 107 of reduced response are also present at the midpoint of each wall. These areas 107 are not present in a room 109 which has sides that are thirty-eight feet in length or in smaller rooms.

Figure 12:
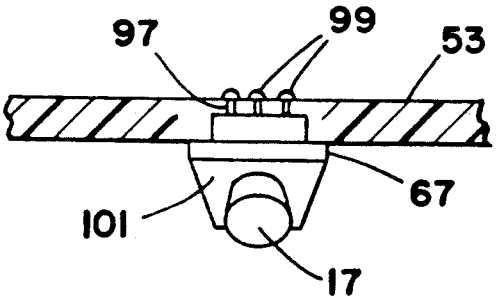
FIG. 12 is a view corresponding to FIG. 8 showing a first modification of the components to provide a different detection pattern.
Figure 13:
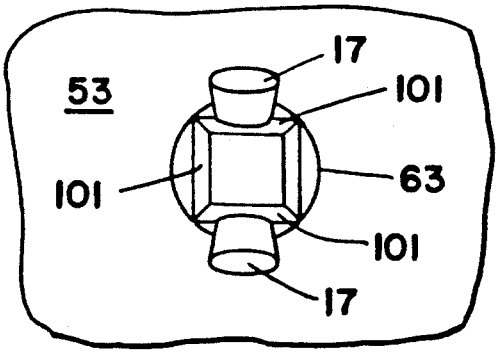
FIG. 13 is a view of the underside of the components that are depicted in FIG. 12.

Differing detection patterns may be more suitable for some rooms. For example, a relatively narrow detection pattern is appropriate for a hallway or corridor. Referring jointly to FIGS. 12 and 13, this may be provided for by mounting the adapter 63 in an orientation at which it is rotated 45° from the orientation which has been previously described and by providing only two detectors 17 which are situated on the adapter sides 101 that face towards the ends of the sensor 16. Referring to FIG. 2, the detectors then receive focused infrared through the ones of the lens element arms 96 that are parallel to the ends of the sensor 16.

Figure 14:
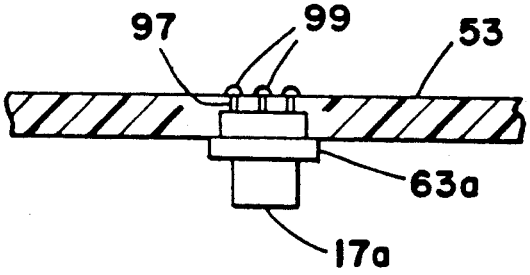
FIG. 14 is a view corresponding to FIGS. 8 and 12 but showing a second modification of the components to provide still another detection pattern.

The lens 22 configuration is also compatible with sensors 16 for smaller rooms that have only one detector. Referring to FIG. 14, a modified adapter 63*a* for this purpose may have a cylindrical configuration and the single detector 17*a* may be secured to the bottom surface of the adapter and be directed downward. Referring jointly to FIGS. 2 and 14, the detector 17*a* then receives infrared through the flat central area 94 at the base of the lens 22 and also from each of the arms 96 of the lens if the adapter is proportioned to position the front end of the detector at the location where the infrared rays from each such arm intersect each other.

In some instances it may be desirable to make the sensor 16 insensitive to infrared which originates at one or more particular locations in a room. Some appliances, for example, emit varying levels of infrared energy that could affect operation of the sensor 16. Referring to FIG. 2, this is readily accomplished by masking those portions of the lens 22 which are directed towards such infrared sources with pieces of infrared opaque material 111 which are sized to conform with the area of the lens that is to be made insensitive and which are attached to the lens with adhesive or by other means Referring to FIG. 15, circuit components which are formed on or supported by the printed circuit board 53 include a low voltage D.C. power supply 112 which receives the 24 volt D.C. voltage from the previously described first and second sensor lead wires 33 and 34 and which has an output terminal 113 which provides a lower voltage for operating the solid state components of the circuit. The negative lead wire 34 is also connected to a chassis ground which is designated by a inverted triangle throughout FIG. 15.

Figure 15:
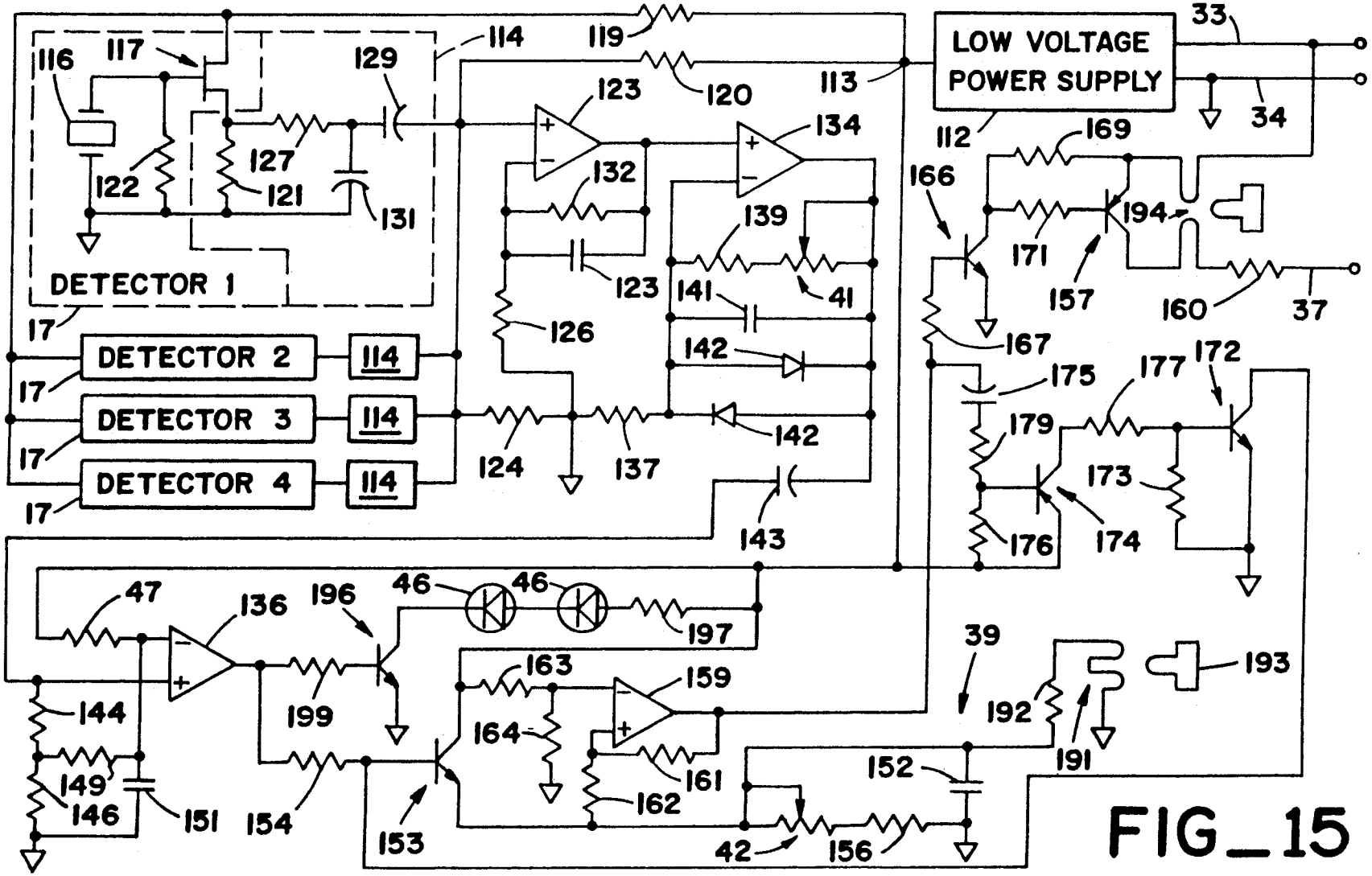
FIG. 15 is a schematic circuit diagram showing a preferred electrical circuit for the sensor of the preceding figures.

The four detectors 17 each have identical components and have identical pulse output circuits 114 and thus only the first detector and pulse output circuit is depicted in detail in FIG. 15. Each such detector includes a small body 116 of one of the known pyroelectric materials which exhibit a change of electrical potential when the material is irradiated by infrared energy. Each detector also includes an FET transistor 117 having a source terminal which receives voltage from the low voltage power supply terminal 113 through a resistor 119, a drain terminal connected to ground through a resistor 121 and a gate terminal which is connected to ground through still another resistor 122. The pyroelectric body 116 is connected in parallel with the gate resistor 122 and thus provides a gating signal which controls conduction through the transistor 117. This causes the voltage drop across resistor 121 to vary in response to variations of the intensity of the infrared that reaches the pyroelectric body 116.

A high gain first operational amplifier 123 functions to amplify the weak detector signals to a magnitude suitable for processing by other components of the circuit. The positive or non-inverting input of amplifier 123 is connected to low power terminal 113 through a voltage dropping resistor 120 and to ground through another resistor 124. The negative or inverting input is connected to ground through still another resistor 126. Electrical pulses indicative of voltage variations at the output of transistor 117 are transmitted to the positive input through a input resistor 127 and input capacitor 129. A smaller capacitor 131, connected between the input side of capacitor 129 and ground, suppresses circuit noise. Feedback resistor 132 and compensating capacitor 133, connected in parallel between the output and negative input of amplifier 123, establish the desired high gain characteristics.

As the detector signals are transmitted to amplifier 123 through a capacitor 129, the amplifier operates in a differentiating mode and is responsive to rate of change of the amplitude of the signals rather than to the absolute amplitude of the signal. This enables the sensor to respond only to abrupt changes of infrared intensity. Slower changes can arise from causes other than human activity. For example, solar radiation entering the room may vary throughout the day. The sensor is in effect a detector of movement of a human body.

A second amplifier 134 and third amplifier 136 enable adjustment Of the sensitivity of the sensor to infrared fluctuations. Output pulses from the first amplifier 123 are transmitted to the positive input of the second amplifier 134 which has a negative input connected to ground through another resistor 137. Feedback components of second amplifier 134 which are connected between the output and negative input of the second amplifier 134 include the previously described variable resistance 41 which is in series with a fixed resistance 139, a compensating capacitor 141 and two oppositely oriented diodes 142. The variable resistance 41 enables selective adjustment of the gain of the second amplifier 134. Diodes 142 establish a bandwidth for the amplifier output pulses.

The third amplifier 136 is configured as a comparator and produces a timer circuit triggering signal in response to output pulses from second amplifier 134 that have an amplitude equal to or greater than a particular fixed value. This enables the sensitivity adjustment since the gain of second amplifier 134 can be varied by adjusting the variable feedback resistor 41.

The output pulses from second amplifier 134 are transmitted to the positive input of the third amplifier 136 through another capacitor 143 and the positive input is also connected to ground through resistors 144 and 146 which are in series. The negative input of comparator amplifier 136 receives reference voltage from low voltage terminal 113 through an input resistor 147 and additional resistor 149 is connected between the negative input and the junction between resistors 144 and 146. Thus the resistors 147, 149 and 146 jointly act as a voltage divider and fix the magnitude of the reference voltage that is applied to amplifier 136. A capacitor 151 is connected between the negative input and ground to suppress transient voltage fluctuations at the input.

The output pulses from third amplifier 136 cause charging of a high value capacitor 152 of the timer circuit 39. For this purpose, one side of capacitor 152 is grounded and the other side is connected to the emitter of an NPN transistor 153. The collector of transistor 153 receives positive voltage from low power terminal 113 and output pulses from third amplifier 136 are transmitted to the base of the transistor through a resistor 154. Thus transistor 153 is turned on and delivers charging current to timer capacitor 152 during each amplifier output pulse.

The previously described variable resistor 42 and a fixed resistance 156 are connected between the input side of capacitor 152 and ground to discharge the capacitor over a period of time unless it is recharged during that period by detection of another abrupt infrared energy fluctuation. As previously described, the variable resistor 42 enables adjustment of the discharge time period to meet the needs of a particular room.

A PNP transistor 157 transmits 24 volt current from the first sensor lead wire 33 to the third or output lead wire 37 of the sensor during periods when capacitor 152 is charged to a predetermined voltage level or to a higher level. The collector of transistor 157 receives current from the first lead wire 33 and the emitter of the transistor is connected to the third or output lead wire 37 through a current limiting resistor 160.

To control transistor 157, a fourth amplifier 159 with a high feedback resistance 161 has a positive input which is connected to the timer capacitor 152 through resistor 162 and a negative input which receives voltage from low power terminal 113 through a resistor 163. The negative input is also connected to ground through another resistor 164. Thus amplifier 159 produces an output voltage when timer capacitor 152 is charged above a particular voltage that is fixed by the relative values of resistors 163 and 164 which function as a voltage divider.

Output voltage from fourth amplifier 159 is transmitted to the base of another NPN transistor 166 through a resistor 167. The emitter of transistor 166 is grounded and the collector of the transistor receives voltage from sensor lead wire 33 through resistor 169. Thus transistor 166 is biased into conduction by the output voltage from fourth amplifier 159. The base of the previously described transistor 157 is connected to the collector of transistor 166 by a resistor 171. Thus transistor 157 is turned on by the voltage drop which occurs at the collector of transistor 166 when transistor 166 itself becomes conductive. This applies 24 volt current from sensor input lead 33 to the output lead 37 to actuate the device which is controlled by the sensor in the manner which has been previously described.

Still another NPN transistor 172 functions to turn off the timer capacitor charging transistor 153 after each charging of timer capacitor 152 so that amplifier 159 may respond to the voltage on the capacitor rather than to voltage received through transistor 153. For this purpose, the collector of transistor 172 is connected to the base of the charging transistor 153 and the emitter of transistor 172 is grounded. A resistor 173 is connected between the base of transistor 172 and ground.

Transistor 172 is briefly biased into conduction after charging of the timer capacitor 152 by still another PNP transistor 174. The emitter of transistor 174 is connected to low voltage terminal 113 and the base is coupled to terminal 113 through a resistor 176. The collector of transistor 174 is connected to the base of transistor 172 through a resistor 177 and thus to ground through resistor 173. The output of amplifier 159 is coupled to the base of transistor 174 through a capacitor 175 and input resistor 179. Consequently, the leading edge of the amplifier 159 output which results from each charging of timer capacitor 152 briefly gates transistor 174 into conduction. This turns transistor 172 on momentarily to bring about a brief grounding of the base of transistor 153 which abruptly stops conduction through that transistor. This allows the timer capacitor 152 to discharge slowly through the high resistances 42 and 156 and enables amplifier 159 to respond to the decaying voltage after a period of time by turning off the sensor output controlling transistors 157 and 166 unless a recharging of the capacitor has occurred in the interim.

As previously described, testing of the sensor following installation can be expedited by temporarily foreshortening the time interval during which the sensor actuates a controlled device following detection of an infrared fluctuation. For this purpose, a pair of spaced apart contacts 191 and a resistor 192 are connected in series between ground and the voltage input side of timer capacitor 152. Foreshortening of the time interval is accomplished by temporarily inserting the blade of a metal key 193 between contacts 191 to establish a conductive path from the capacitor 152 to ground through resistor 192. The resistance of resistor 192 is lower than that of the resistors 42 and 146 and thus decay of the charge on capacitor 152 occurs more rapidly than is the case when the key 193 is absent.

Key 193 or a similar key may also be used to effectively bypass the sensor at times when it is desired that the controlled device remain on without regard to human occupancy of the room. For this purpose, one of another pair of spaced apart contacts 194 is connected to the sensor power input lead wire 33 and the other contact is connected to the sensor power output lead wire 37 through current limiting resistor 160. Bridging of contacts 194 with the blade of key 193 results in a continual flow of current to the controlled device.

The previously described light emitting diodes 46 which blink on and off each time that motion of a human body is detected are connected between low power terminal 113 and the collector of another NPN transistor 196 in series with each other and in series with a resistor 197, the emitter of the transistor being grounded. Another resistor 199 transmits the output pulses from comparator amplifier 136 to the base of transistor 196 to momentarily turn the transistor on in response to each pulse and thereby cause momentary light emission from diodes 46.

Referring again to FIG. 1, the domed lens 22 configuration as herein described is adapted to focus infrared onto one or more infrared detectors 17. The lens construction can be also be adapted to focus other wavelengths, such as visible light, towards detectors by using lens materials that are transmissive of the other wavelengths.

While the invention has been described with respect to certain specific embodiments for purpose of example, many variations and modifications are possible and it is not intended to limit the invention except as defined in the following claims.

I claim:

1. A sensor for detecting occupancy of a room, said sensor having a housing adapted to be secured to the ceiling of said room, means for detecting changes of infrared radiation intensity which detection means includes at least a pair of infrared sensing components and means for actuating at least one electrically controlled device in response to detection of changes of infrared intensity by said detection means, wherein the improvement comprises:

a substantially dome shaped infrared transmissive lens secured to said housing and extending downward therefrom, said lens having a lower end spaced below said housing and a larger diameter upper end situated adjacent said housing and wherein portions of said lens that are progressively further from said housing are of progressively smaller diameters, said lens having a plurality of infrared focusing Fresnel lens segments formed thereon which are arranged in a plurality of vertically extending series of lens segments which series are disposed in side-by-side relationship around the circumference of said dome shaped lens and wherein successively higher ones of the lens segments of each group have progressively greater inclinations, said lens segments being oriented to direct intercepted infrared radiation towards a location which is underneath said housing and within the space defined by said dome shaped lens, and means for supporting at least a pair of said infrared sensing components, which supporting means causes said components to extend downward from said housing at said location and holds said components in orientation at which said pair of components face outwardly and downwardly in opposing directions to intercept infrared from opposite ones of said plurality of series of lens segments.

2. The sensor of claim 1 wherein said lens includes a substantially dome shaped outer cage having a plurality of infrared transmissive regions which face in different directions, a substantially dome shaped inner cage also having a plurality of infrared transmissive regions that face in different directions and which is disposed within said outer cage in nesting relationship therewith, and a sheet of infrared transmissive material sandwiched between said outer and inner cages and being held in a substantially dome shaped configuration thereby, said sheet of material having said lens segments formed therein, further including means for snap engaging said outer cage to said inner cage when said cages are in said nesting relationship with each other, wherein said snap engaging between said inner and outer cages enables assembly of said lens prior to securing of said lens to said housing.

3. The sensor of claim 1 wherein said housing has an undersurface with an opening and wherein said means for supporting said infrared sensing components includes an adapter disposed at said opening and which supports said infrared sensing components at said location such that at least the infrared sensitive faces of said components extend below said upper end of said lens, and wherein said dome shaped lens is disposed against said housing undersurface under said opening and in a substantially centered relationship with said adapter.

4. The sensor of claim 3 wherein said adapter has means for supporting a plurality of said infrared sensing components in a plurality of different orientations relative to said adapter, and wherein said detection means includes four of said infrared sensing components secured to said adapter and facing in different directions and each being directed towards different ones of said plurality of series of lens segments that are located at 90 degree intervals around said circumference of said dome shaped lens.

5. In a sensor for detecting the presence of persons in a room, the combination comprising:

a housing having a bottom surface with an opening therein and having means for enabling attachment of said housing to the ceiling of said room, a plurality of infrared radiation sensing components disposed at said opening of said housing and having infrared sensitive areas which face downwardly and outwardly in different directions including in opposing directions and which extend below said housing, timer means for actuating an electrically controlled device for an interval of time in response to each detection of an abrupt change of infrared intensity by any of said sensing components, a substantially dome shaped infrared transmissive lens secured to said bottom surface of said housing and which encircles said radiation sensing components, said lens having an outer framework and inner framework disposed in nested relationship and having a sheet of infrared transmissive material nested between said frameworks, said sheet of material having a plurality of grooves in a surface thereof which grooves are shaped to define a plurality of Fresnel lens segments which are oriented to focus intercepted infrared radiation in the direction of said sensing components.

6. A sensor for detecting occupancy of a room, said sensor having a housing adapted to be secured to the ceiling of said room, means for detecting changes of infrared radiation intensity which detecting means includes an infrared sensing component having an infrared sensitive area, and means for actuating at least one electrically controlled device in response to detection of changes of infrared intensity by said detection means, wherein the improvement comprises:

a substantially dome shaped infrared transmissive lens secured to said housing and extending downward therefrom, said lens having a lower end spaced below said housing and a larger diameter upper end situated adjacent said housing and wherein portions of said lens that are progressively further from said housing are of progressively smaller diameters, said lens having a plurality of infrared focusing Fresnel lens segments formed thereon which are arranged in a plurality of vertically extending series of lens segments which series are disposed in side-by-side relationship around the circumference of said dome shaped lens and wherein successively higher ones of the lens segments of each group having progressively greater inclinations, said lens segments being oriented to direct intercepted infrared radiation towards a location which is underneath said housing and within the spaced defined by said dome shaped lens, and means for supporting said infrared sensing component which supporting means positions said infrared sensitive area of said infrared sensing component at said location.

* * * * *